US006515626B2

(12) United States Patent
Bark et al.

(10) Patent No.: US 6,515,626 B2
(45) Date of Patent: Feb. 4, 2003

(54) PLANAR MICROSTRIP PATCH ANTENNA FOR ENHANCED ANTENNA EFFICIENCY AND GAIN

(75) Inventors: Hang-Gu Bark, Ichon-shi (KR); Hyun-Bo Yoon, Seoul (KR); Dong-Sob Kim, Ichon-shi (KR)

(73) Assignee: Hyundai Electronics Industries (KR)

( * ) Notice: Subject to any disclaimer, the term of this patent is extended or adjusted under 35 U.S.C. 154(b) by 0 days.

(21) Appl. No.: 09/745,327

(22) Filed: Dec. 21, 2000

(65) Prior Publication Data

US 2002/0008664 A1 Jan. 24, 2002

(30) Foreign Application Priority Data

Dec. 22, 1999 (KR) ..... 99-60437
Dec. 22, 1999 (KR) ..... 99-60438
Dec. 22, 1999 (KR) ..... 99-60440
Dec. 22, 1999 (KR) ..... 99-60442

(51) Int. Cl.[7] ..... H01Q 1/26
(52) U.S. Cl. ..... 343/700 MS; 343/767; 343/895
(58) Field of Search ..... 343/700 MS, 767, 343/770, 806, 895, 702

(56) References Cited

U.S. PATENT DOCUMENTS

| | | | | | |
|---|---|---|---|---|---|
| 4,644,343 | A | * | 2/1987 | Schneider et al. | 343/767 |
| 5,760,747 | A | * | 6/1998 | McCoy et al. | 343/725 |
| 5,872,542 | A | * | 2/1999 | Simons et al. | 343/700 MS |
| 5,914,693 | A | * | 6/1999 | Takei et al. | 343/767 |
| 5,926,139 | A | | 7/1999 | Korisch | 343/702 |
| 6,028,567 | A | | 2/2000 | Lahti | 343/895 |
| 6,078,823 | A | | 6/2000 | Chavez et al. | 455/562 |
| 6,081,241 | A | * | 6/2000 | Josefsson et al. | 333/26 |
| 6,091,366 | A | | 7/2000 | Zhang et al. | 343/700 MS |
| 6,111,545 | A | | 8/2000 | Saari | 343/702 |

* cited by examiner

*Primary Examiner*—Tan Ho
(74) *Attorney, Agent, or Firm*—Baker Botts LLP

(57) ABSTRACT

A planar microstrip patch antenna of the present invention has a high antenna efficiency and gain by implementing a microstrip patch formed in a shape of a zigzag or a H-slot. The planar microstrip patch antenna includes a substrate made of a dielectric material, a microstrip patch, made of a conductive metal, formed on the substrate, a feeding conductor to electrically connect to an end of the microstrip patch, and a ground face disposed on a side of the substrate.

6 Claims, 9 Drawing Sheets

E-PATTERN

H-PATTERN

E-PATTERN

H-PATTERN

E-PATTERN

H-PATTERN

PLANAR MICROSTRIP PATCH ANTENNA FOR ENHANCED ANTENNA EFFICIENCY AND GAIN

FIELD OF THE INVENTION

The present invention relates to an antenna for a mobile station; and, more particularly, to a planar microstrip patch antenna having improving antenna efficiency and high gain, and arranged for installation in a mobile station.

DESCRIPTION OF THE PRIOR ART

In recent years, mobile stations are used in both a personal communication service (PCS) and a wireless local loop (WLL) in which a different communication frequencies are used. Thus, it is necessary for an antenna to operate in frequency corresponding to each service.

Among the antennae for satisfying the above, a helical antenna is popularly used in the mobile station at the present time. One type is capable of being operated as a helical antenna at a retraction state and operated as a combination of the helical antenna and a monopole antenna in an extended state. In this antenna device, a housing of the handheld mobile station is generally used as a ground plane.

Referring to FIGS. 1A and 1B, there is shown the conventional helical antenna 100 for the mobile station, wherein each figure illustrates the antenna in a retracted state and extended state, respectively. The helical antenna of the previous art includes a rod antenna 8 having a conductive core 12 therein and a insulator 14 covering the outside of the conductive core 12, a support member 10 for supporting the rod antenna 8, made of an insulating and a non-magnetic material, a button 16 for functioning as a gripper for extending and retracting the rod antenna 8, a helical antenna 6 made of a resilient metal wire in a spiral shape, a hood 18 having an aperture 20 on the top thereof, made of an insulating and a non-magnetic material, a contact washer 22 made of metal, for being in galvanic contact with the helical antenna 6 and an abutment 28 in the transition region between the lower and upper regions of the rod antenna. The abutment 28 plays a role in lifting the contact washer 16 so that the helical wire is compressed as shown in FIG. 1B.

The connecting portion 26 is galvanically directly connected to the transceiver 2. In the active state of the helical antenna 6, the contact washer 22 abuts against the contact device 24 so that galvanic connection is obtained between the helical antenna 6 and the connecting portion 26 and thereby also direct to the transceiver 2. Whereas, in the passive state, i.e., the extended state, the helical antenna 6 is galvanically separated from the transceiver 2.

In the helical antenna device 100, there are several drawbacks such that the mobile station is hardly miniaturized because the antenna is attached on the exterior of the mobile station and a user's head is subjected to an electromagnetic wave due to a concentration of the radiation near the center of the antenna. Moreover, the helical antenna device 100 also has a problem that radiation efficiency is decreased because the radiation of the antenna is disturbed by the user.

SUMMARY OF THE INVENTION

It is, therefore, an object of the present invention to provide a planar microstrip patch antenna for improving antenna efficiency and gain by implementing a microstrip patch formed in a shape of a zigzag conduction or an H-slot.

In accordance with one aspect of the present invention, there is provided a planar microstrip patch antenna, comprising: a substrate made of a dielectric material; a microstrip patch, made of a conductive metal, formed on the substrate; a feeding conductor to electrically connect to an end of the microstrip patch; and a ground face disposed on a side of the substrate.

DETAILED DESCRIPTION OF THE PREFERRED EMBODIMENTS

Figure 1A:
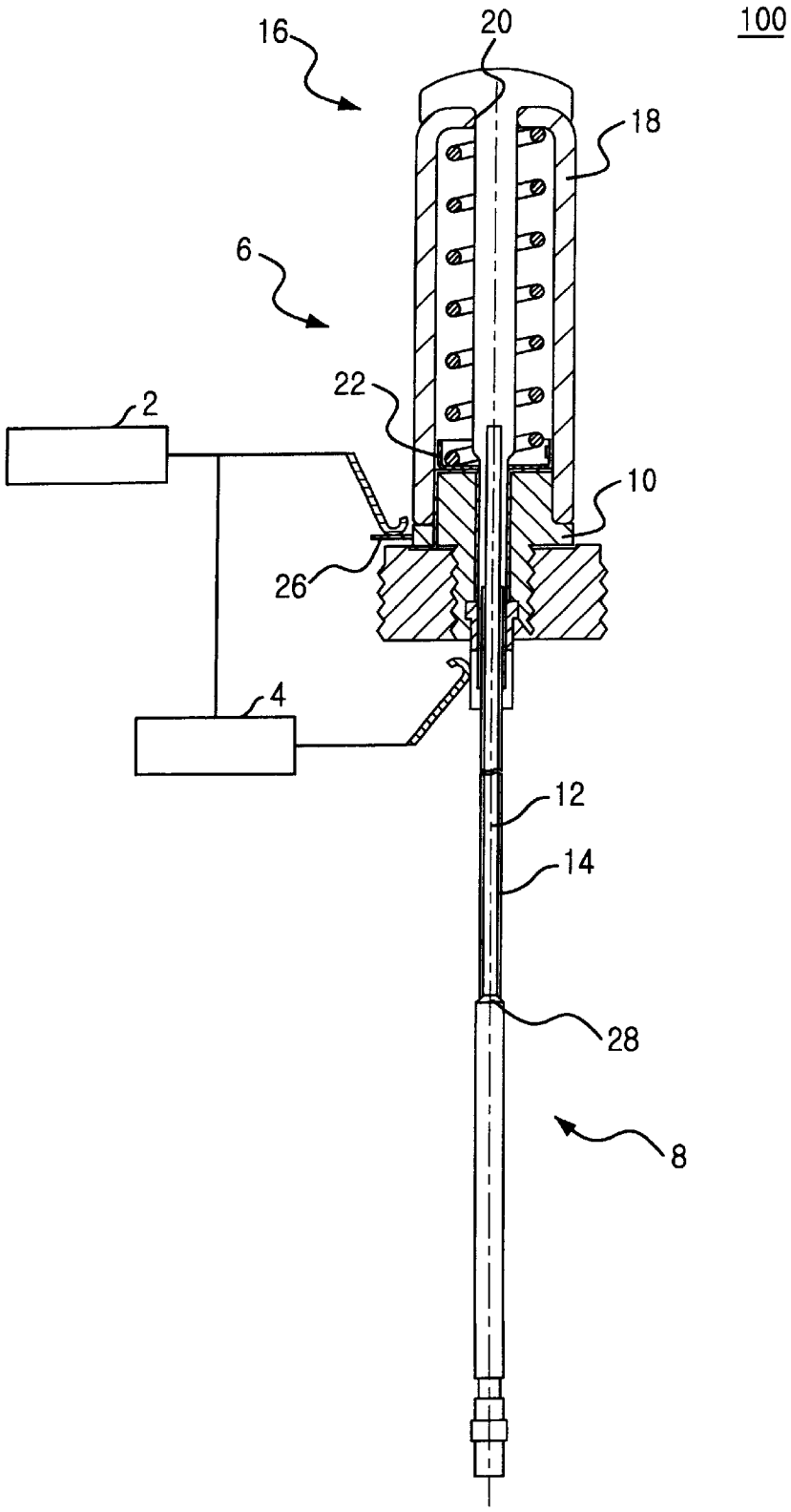
FIG. 1A (PRIOR ART)
FIGS. 1A and 1B show cross sectional views of a conventional helical antenna.
Figure 1B:
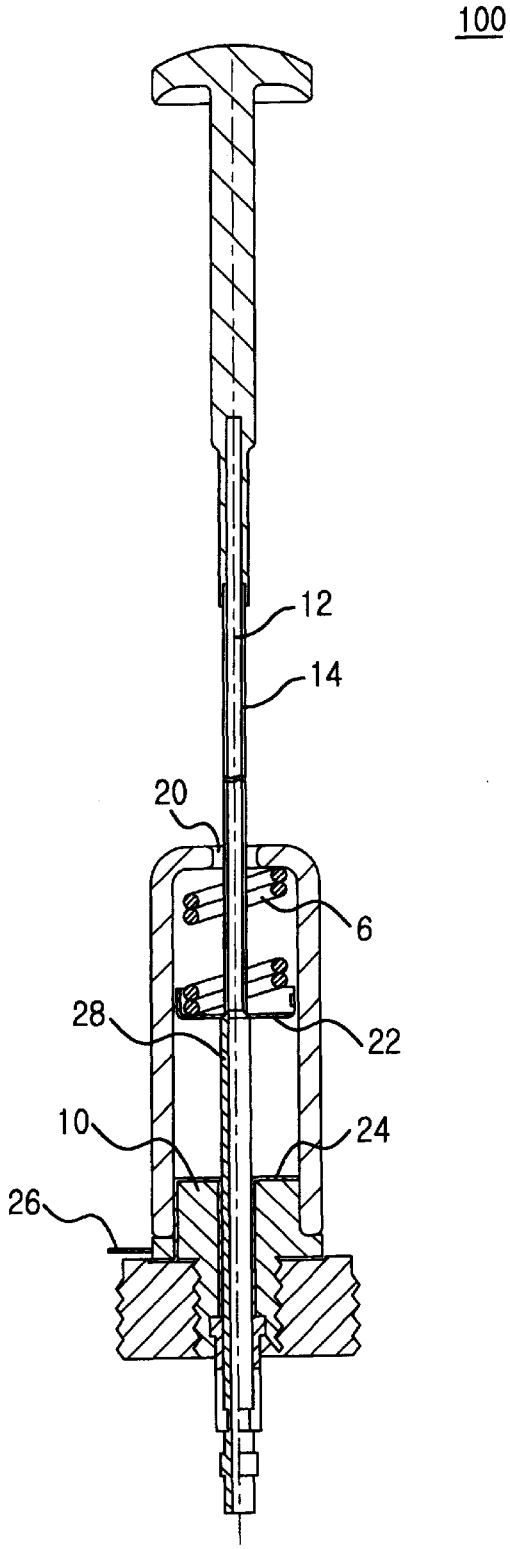
FIG. 1B (PRIOR ART)
Figure 2A:
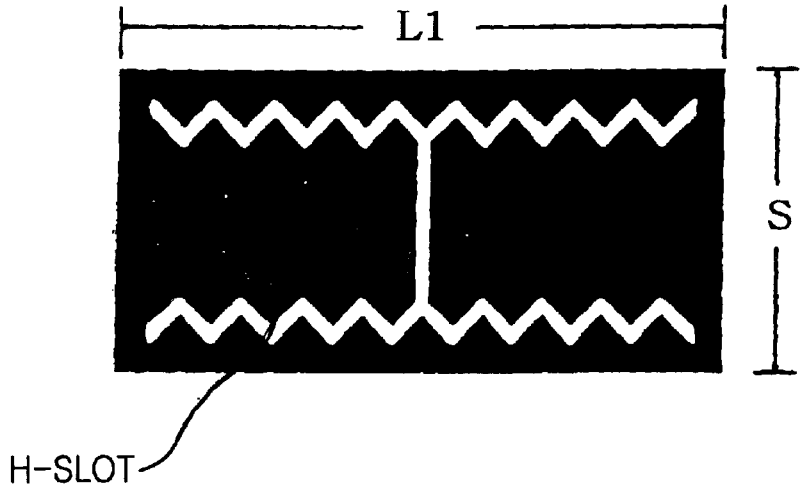
FIGS. 2A and 2B illustrate schematic views of a planar H-slot microstrip antenna of a first preferred embodiment of the present invention.
Figure 2B:
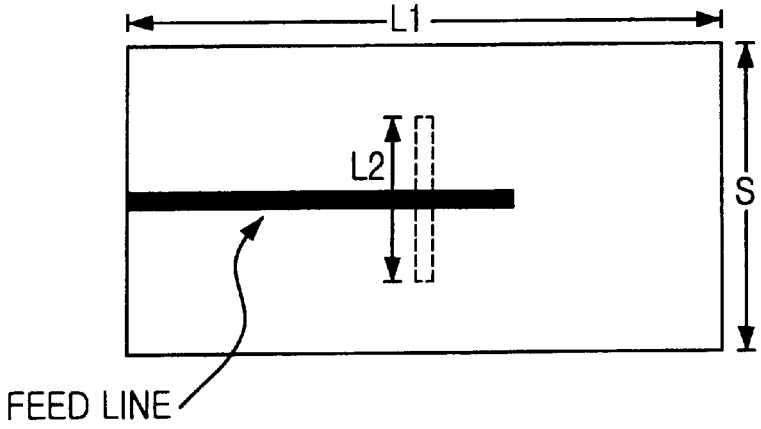

Referring to FIGS. 2A and 2B, there are schematic views of a H-slot planar microstrip antenna 200 in accordance with a first preferred embodiment of the present invention, which can be installed in a mobile station.

FIG. 2A is a view of a first surface the H-slot planar microstrip antenna 200. The H-shaped slot includes first and second substantially parallel zig-zag slot portions and an interconnecting control slot portion therebetween. In this figure, a wrinkled zig-zag H-slot is formed into a conductive metal plate on a first side of a substrate. The length of the slot (L1) is one-quarter wavelength. A feeding method of an RF connection, as shown in FIG. 2B, provides an enhanced radiation efficiency so that a strong signal is radiated. Furthermore, this feeding method presents a wide band property and an excellent impedance matching, which can be adjusted by adjusting the length of the feed line.

The feeding to the antenna is carried out by a feed line as referred to FIG. 2B. The feed line, which plays a critical role in supplying a predetermined power to the H-slot and inputting the received signal to the slot simultaneously, is extended across the interconnecting slot portion of the middle of the H-slot as well shown in FIG. 2B.

The specification of the planar H-slot microstrip antenna 200 is illustrated in Table 1 as follows. That is, a center frequency is 1.8 GHz, bandwidth is 170 MHz, and impedance is 50 ohms. The gain, which represents the antenna's effective radiated power as compared to the effective radiated power of an isotropic antenna, is approximately 2 dBi, wherein the isotropic antenna is a theoretic antenna that radiates an electromagnetic energy equally well in all directions. Here, the higher the antenna's gain the narrower the antenna's radiation pattern. Therefore, if all other characteristics are equal, the antenna with high gain will be more effective at distance than the antenna which radiates in all directions.

Additionally, a voltage standing wave ratio (V.S.W.R.) in the Table 1 means a ratio between the sum of the forward voltage and the reflected voltage and the difference between the forward voltage and the reflected voltage.

TABLE 1

| Parameter | Value |
|---|---|
| Center frequency | 1.8 GHz |
| Bandwidth | 170 MHz |
| Impedance | 50 ohms |
| V.S.W.R. | 1.9:1 (Max) |
| Gain | 2 dBi |
| Size (W × L × H) | 15 × 16 × 8 (mm) |

Figure 3A:
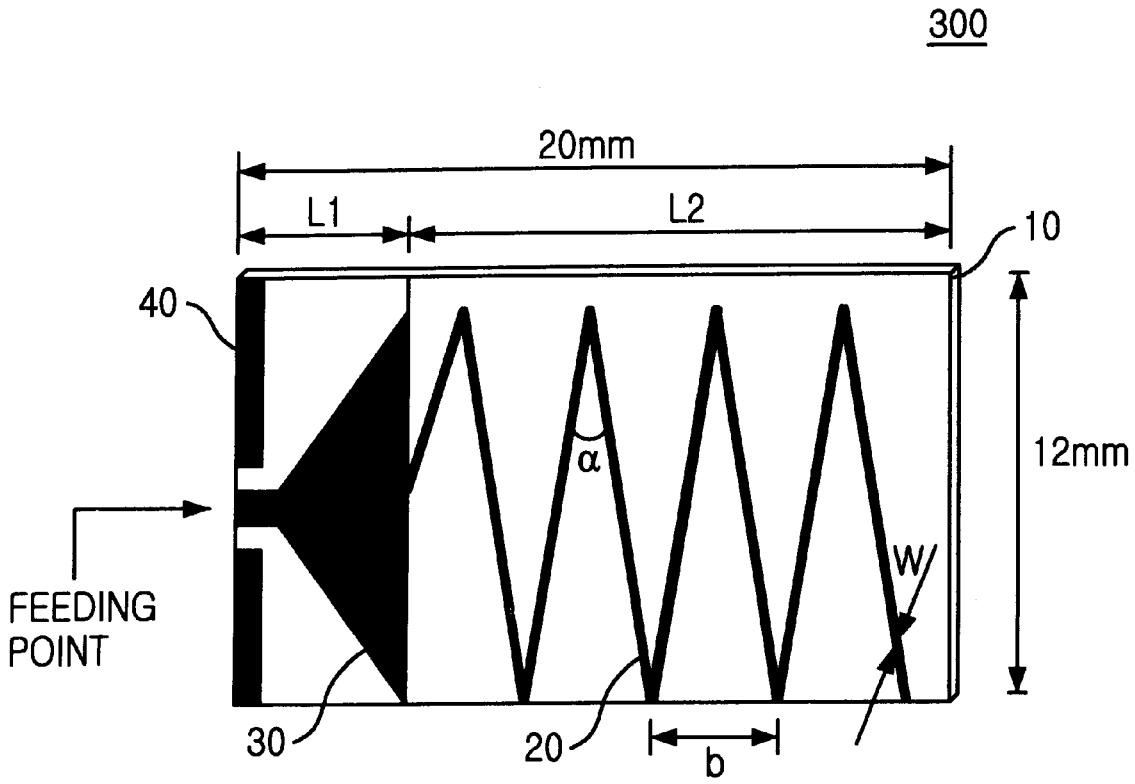
FIGS. 3A to 3C depict schematic views of a one conductor zigzag-shape microstrip patch antenna of a second embodiment of the present invention.
Figure 3B:
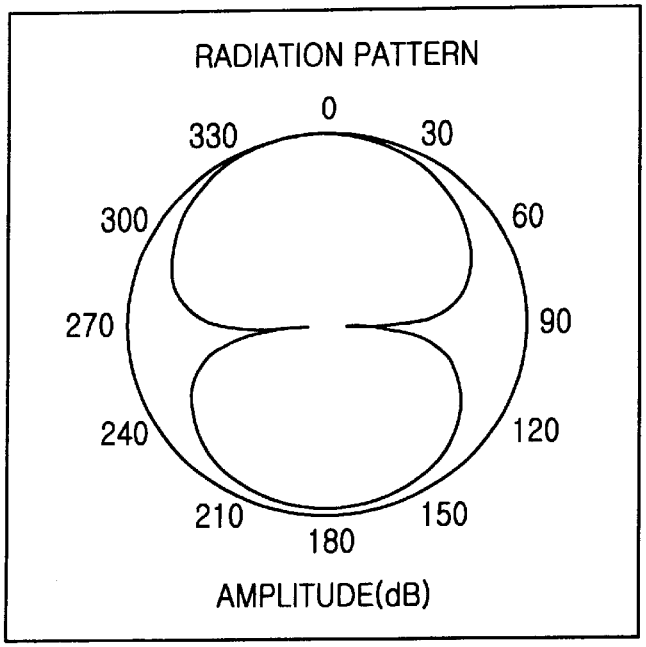
Figure 3C:
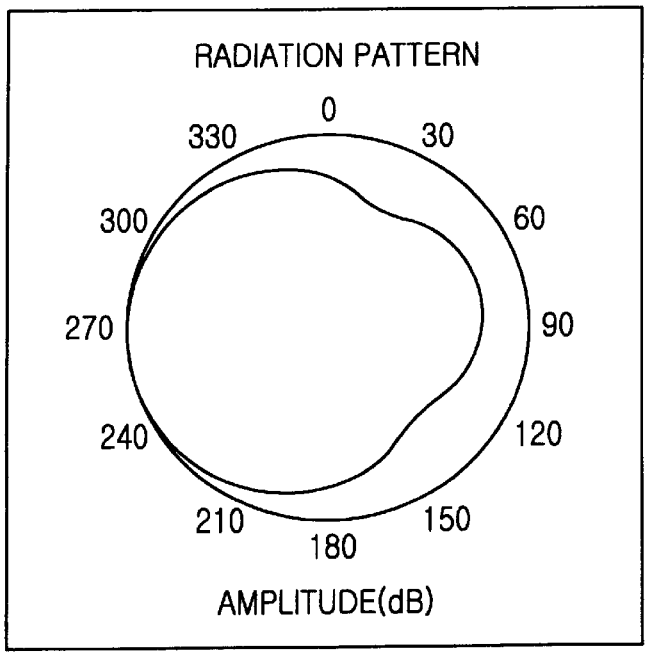

Referring to FIGS. 3A to 3C, there is shown a one conductor zigzag-shape microstrip patch antenna 300 in accordance with a second preferred embodiment of the present invention, which may be installed in a mobile station. The fabrication process of the antenna 300 may be as followings.

A substrate 10 with a high dielectric constant of about 2.33 which may be made of a RT-duroid 5880™is prepared in advance and then a metal layer and a photoresist layer are formed on top of the substrate 10, sequentially. In a next step, the photoresist layer is stripped off in a predetermined configuration. The metal layer is patterned into a microstrip conductor having the zigzag-shaped configuration by exposing the photoresist layer via a mask. A triangle pad 30 of a feeding conductor and a ground face 40 are likewise formed. Here, the triangle pad 30 and the ground face 40 are made of conductive metals and are arranged to provide impedance matching of the antenna to a transmission line, such as a 50 ohm line.

As shown in FIG. 3A, L1 is 5 mm, the length of the patch (L2) and its width are about 15 mm and 12 mm, respectively. The distance between turns (b) is about 3.5 mm, the angle of the pitch is about 16.59° and the thickness of the conductive strip is 0.3 mm.

FIG. 3B is an E-plane radiation pattern of the antenna and FIG. 3C is a H-plane radiation pattern of the antenna. The specification of the conductor zigzag-shape microstrip patch antenna 300 is illustrated in table 2. That is, a center frequency is 1.8 GHz, bandwidth is 200 MHz and a gain is approximately 2.8 dBi.

TABLE 2

| Parameter | Value |
|---|---|
| Center frequency | 1.8 GHz |
| Bandwidth | 200 MHz |
| Impedance | 50 ohms |
| V.S.W.R. | 1.9:1 (Max) |
| Gain | 2.8 dBi |
| Size (W × L × H) | 12 × 20 × 8 (mm) |

Figure 4A:
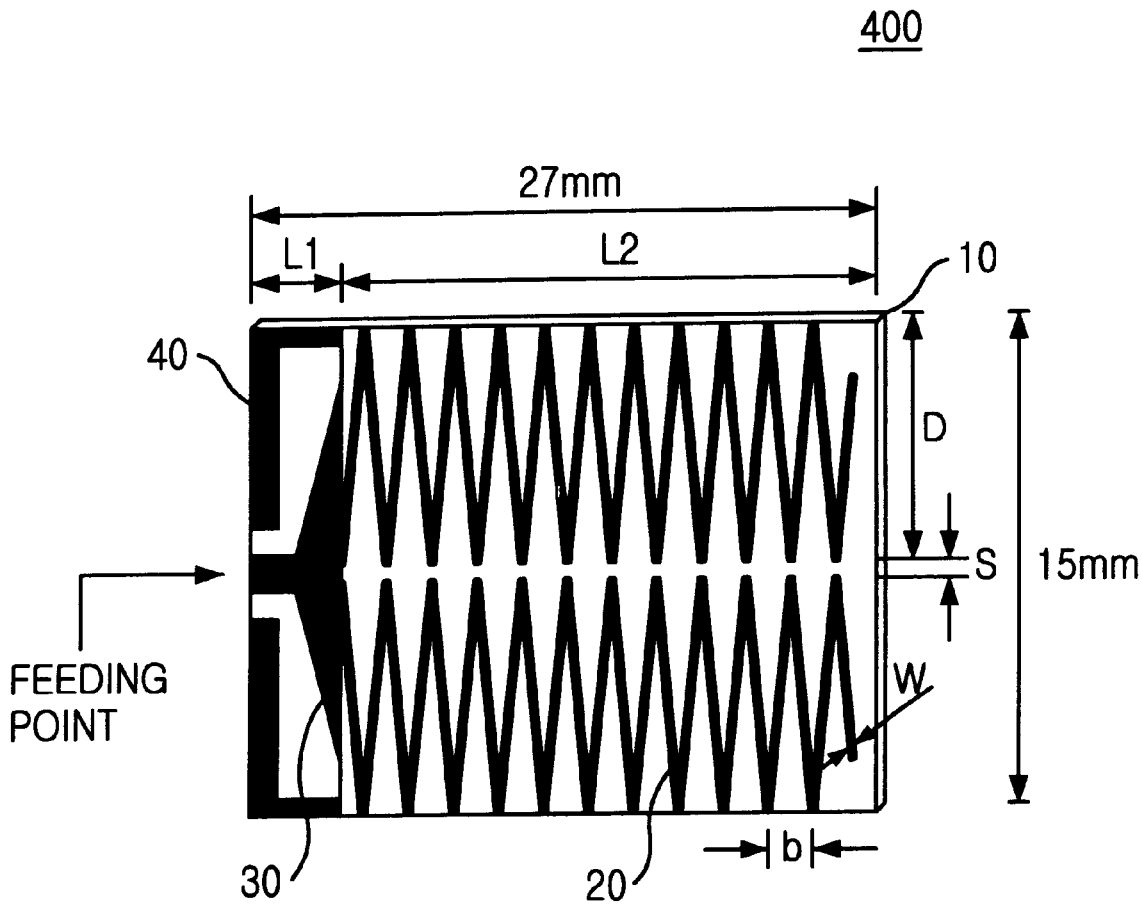
FIGS. 4A to 4C present schematic views of a two conductor zigzag-shape microstrip patch antenna of a third embodiment of the present invention.
Figure 4B:
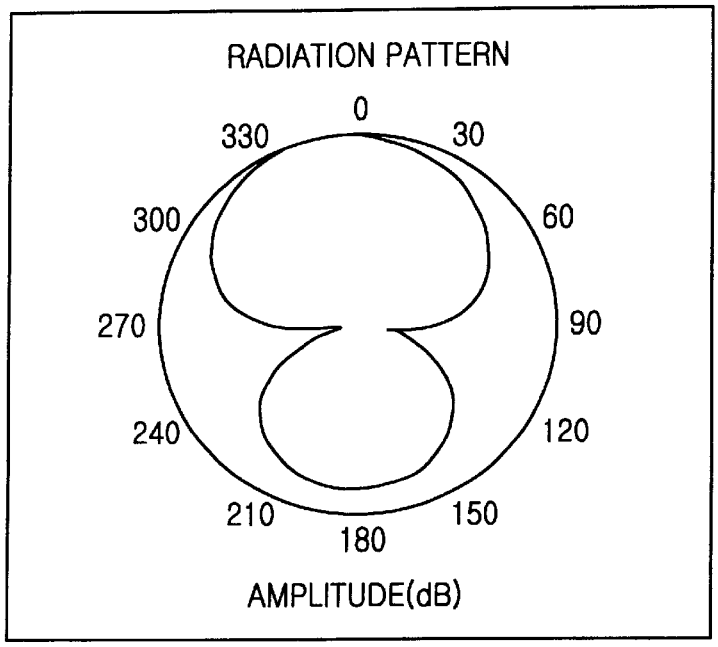
Figure 4C:
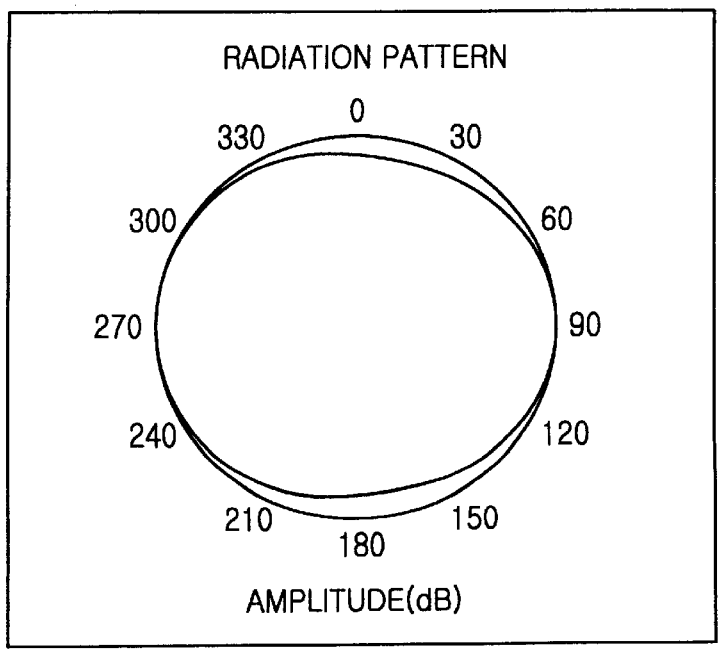

Referring to FIGS. 4A to 4C, there is shown a two conductor zigzag-shape microstrip patch antenna 400 in accordance with a third preferred embodiment of the present invention, which may be installed in a mobile station. The process of fabrication is the same as the zigzag-shape microstrip antenna 300 of the second embodiment.

As shown in FIG. 4A, a width of the substrate is 15 mm and a length is 27 mm. L1 is 5 mm, the length of the conductor (L2) and the width (D) is 22 mm and 7 mm, respectively. The distance between the turns (b) is 1.5 mm, the angle of the pitch is 12.33° and the thickness of the strip is 0.3 mm.

FIG. 4B is an E-plane radiation pattern of the antenna and FIG. 4C shows an H-plane radiation pattern of the antenna. The specification of the two conductor zigzag-shape micro strip patch antenna 400 is set forth in Table 3. That is, a center frequency is 1.8 GHz, bandwidth is 350 MHz and a gain is approximately 2.5 dBi.

TABLE 3

| Parameter | Value |
|---|---|
| Center frequency | 1.8 GHz |
| Bandwidth | 350 MHz |
| Impedance | 50 ohms |
| V.S.W.R. | 1.9:1 (Max) |
| Gain | 2.5 dBi |
| Size (W × L × H) | 15 × 27 × 15 (mm) |

Figure 5A:
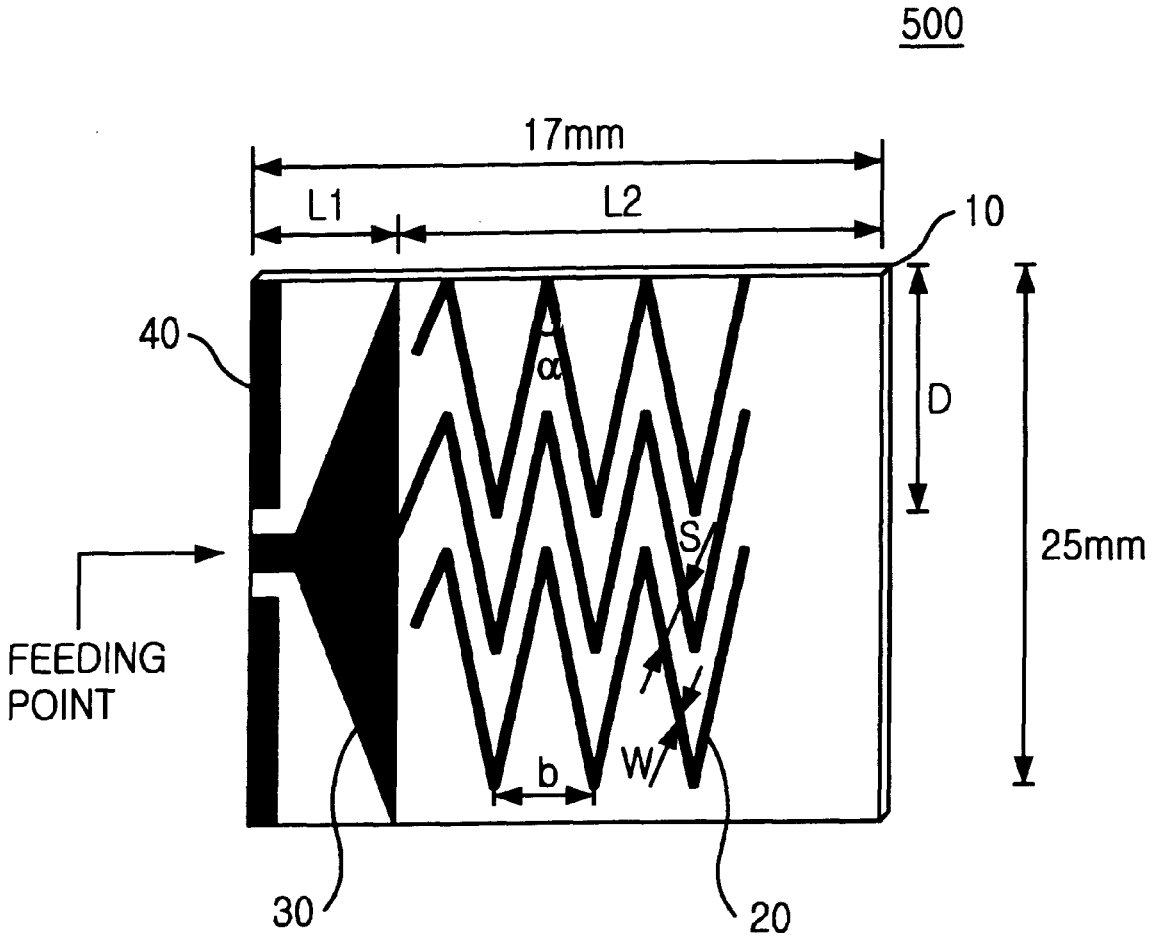
FIGS. 5A to 5C represent schematic views of a three conductor zigzag-shape microstrip patch antenna of a third embodiment of the present invention.
Figure 5B:
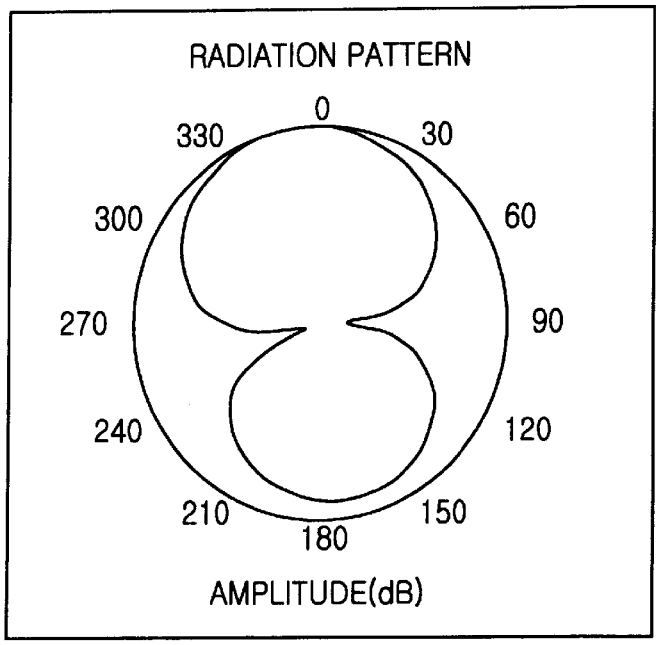
Figure 5C:
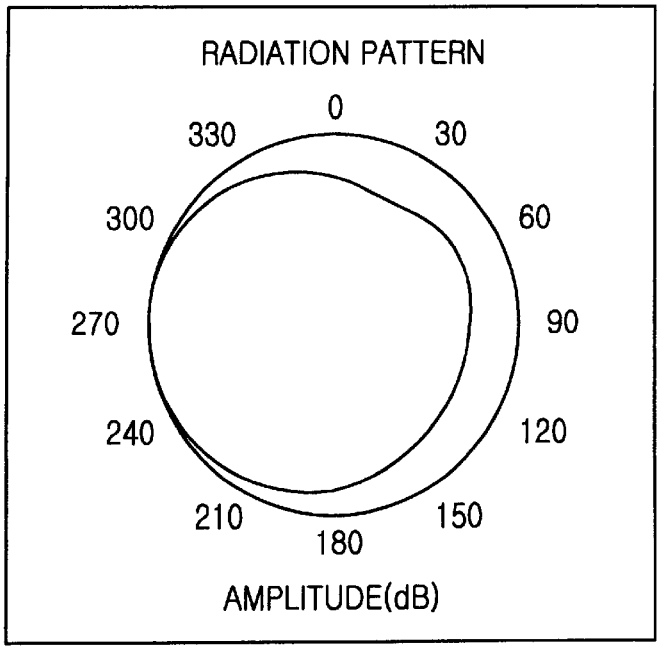

Referring to FIGS. 5A to 5C, there is shown three conductor zigzag-shape microstrip patch antenna 500 in accordance with a fourth preferred embodiment of the present invention, which may be installed in a mobile station. The process of fabrication is also the same as the second and the third embodiments.

As shown in FIG. 5A, a width of the substrate is 25 mm and a length is 17 mm. L1 is 5 mm, the length of the conductor (L2) is designed to be ⅛ wavelength and the diameter (D) is 12 mm. The total length of the patch is ⅓ wavelength when the strip is unfolded. The angle of the pitch is 18.92°. FIG. 5B is an E-plane pattern of the antenna and FIG. 5C is an H-plane pattern of the antenna. The specification of the three conductor zigzag-shape microstrip patch antenna 500 is illustrated in table 4. That is, a center wavelength is 1.8 GHz, bandwidth is 139 MHz and a gain is approximately 1.9 dBi.

TABLE 4

| Parameter | Value |
|---|---|
| Center frequency | 1.8 GHz |
| Bandwidth | 139 MHz |
| Impedance | 50 ohms |
| V.S.W.R. | 1.9:1 (Max) |
| Gain | 1.9 dBi |
| Size (W × L × H) | 25 × 17 × 8 (mm) |

While the present invention has been described with respect to the particular embodiments, it will be apparent to those skilled in the art that various changes and modifications may be made without departing from the scope of the invention as defined in the following claims.

What is claimed is:

1. A planar microstrip antenna comprising a dielectric substrate having a conductive layer on a first surface, said conductive layer having a slot formed therein having the overall shape of an H, said slot comprises first and second substantially parallel slot portions and an interconnecting slot portion extending therebetween, wherein said substantially parallel slot portions comprise zig-zag shaped slots, and an elongated conductor formed on an opposite second surface of said dielectric substrate, wherein said conductor extends across said interconnecting slot to couple signals to said slot for radiation therefrom.

2. A planar microstrip antenna comprising a planar dielectric substrate having at least one elongated conductor on a first side thereof extending outwardly in a zig-zag configuration from an input conductor in the vicinity of a first edge of said substrate, and at least one second conductive arranged in the vicinity of said input conductor, and formed a ground plane with respect to signals on said input conductor.

3. A planar micorstrip antenna as specified claim 2 wherein said elongated conductor comprises a single conductor.

4. A planar microstrip antenna as specified in claim 3 further comprising third and fourth elongated zig-zag conductors said third and fourth zig-zag conductors being arranged on sides of said elongated conductor.

5. A planar microstrip antenna as specified in claim 2 wherein there are provided two said elongated conductors.

6. A planar antenna as specified in claim 2 further including a triangular conductive element arranged between said input conductor and said elongated conductor.

* * * * *